US010851817B2

(12) United States Patent
Van Nesselrooij et al.

(10) Patent No.: US 10,851,817 B2
(45) Date of Patent: Dec. 1, 2020

(54) BODY PROVIDED WITH A SUPERFICIAL AREA ADAPTED TO REDUCE DRAG

(71) Applicant: Dimple Tech B.V., Utrecht (NL)

(72) Inventors: Michiel Van Nesselrooij, Utrecht (NL); Olaf Van Campenhout, Utrecht (NL); Leonardus Louis Maria Veldhuis, Utrecht (NL)

(73) Assignee: DIMPLE IP B.V., The Hague (NL)

( * ) Notice: Subject to any disclaimer, the term of this patent is extended or adjusted under 35 U.S.C. 154(b) by 0 days.

(21) Appl. No.: 16/329,775

(22) PCT Filed: Aug. 18, 2017

(86) PCT No.: PCT/NL2017/050545
§ 371 (c)(1),
(2) Date: Mar. 1, 2019

(87) PCT Pub. No.: WO2018/044155
PCT Pub. Date: Mar. 8, 2018

(65) Prior Publication Data

US 2019/0203747 A1 Jul. 4, 2019

(30) Foreign Application Priority Data

Sep. 1, 2016 (NL) ..... 2017402

(51) Int. Cl.
*F15D 1/00* (2006.01)

(52) U.S. Cl.
CPC ..... *F15D 1/005* (2013.01); *F15D 1/00* (2013.01); *F15D 1/003* (2013.01)

(58) Field of Classification Search
CPC .... B63B 1/00; B63B 1/32; B63B 1/34; B63B 1/36; B63B 1/38; B64C 1/38;
(Continued)

(56) References Cited

U.S. PATENT DOCUMENTS 4,776,535 A * 10/1988 Paterson ..... B62D 35/00 244/130
4,789,117 A * 12/1988 Paterson ..... B62D 35/00 138/37

(Continued)

FOREIGN PATENT DOCUMENTS

EP 0679812 A1 11/1995
EP 2447548 A1 5/2012

(Continued)

OTHER PUBLICATIONS

Mechaninc of drag reduction by shallow dimples in channel flow, by C. M. J. Tay, B. C. Khoo, and Y. T. Chew; Physics of Fluids (1994-present) 27, 035109 (2015); doi: 101063/1.4915069.

*Primary Examiner* — Lars A Olson
(74) *Attorney, Agent, or Firm* — Hoyng Rokh Monegier LLP; David P. Owen

(57) ABSTRACT

Body provided with a superficial area adapted to reduce drag when the body is moving relative to a gaseous or watery medium, comprising depressions in said superficial area, wherein the depressions have a greater length than width and are provided in the superficial area so as to collectively shape a curvature provided in a length direction of said depressions in the superficial area, and/or said depressions themselves are provided with a curvature in their length direction. The depressions are thus adapted to provide that a turbulent boundary layer of the gaseous or watery medium adjacent to the superficial area of the body is exposed to lateral excitation with reference to a movement direction of the body in the gaseous or watery medium or with reference to a flow direction of said turbulent boundary layer along said superficial area of the body. Said lateral excitation results in a reduction of drag.

10 Claims, 2 Drawing Sheets

Figure 1:
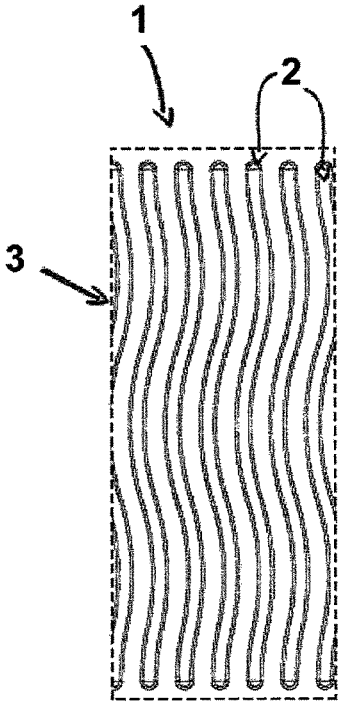
Figure 2:
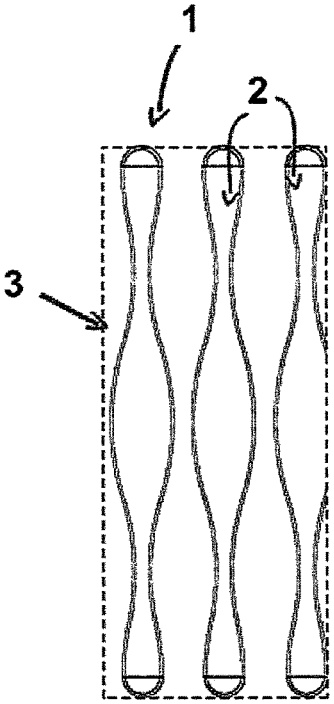

(58) Field of Classification Search
CPC ..... B64C 11/00; B64C 11/16; B64C 11/18; A63B 37/00; A63B 37/12; A63B 37/14; F28F 13/00; F28F 13/18; F15D 1/00; F15D 1/005
USPC ..... 114/67 A, 67 R
See application file for complete search history.

(56) References Cited

U.S. PATENT DOCUMENTS

| | | | | |
|---|---|---|---|---|
| 4,813,635 | A * | 3/1989 | Paterson | B62D 35/001 244/130 |
| 5,114,099 | A | 5/1992 | Gao | |
| 6,006,823 | A | 12/1999 | Kiknadze | |
| 8,323,775 | B2 | 12/2012 | Van Merksteijn | |
| 8,573,541 | B2 | 11/2013 | Sullivan et al. | |
| 2003/0224878 | A1* | 12/2003 | Sullivan | A63B 37/0004 473/378 |
| 2004/0155150 | A1 | 8/2004 | Krohmer et al. | |
| 2005/0227788 | A1* | 10/2005 | Ogg | A63B 37/0004 473/378 |
| 2007/0110585 | A1 | 5/2007 | Bonnet | |
| 2008/0051226 | A1* | 2/2008 | Simonds | A63B 37/0003 473/383 |
| 2009/0090423 | A1 | 4/2009 | Kiknadze et al. | |
| 2015/0251711 | A1 | 9/2015 | Carlson | |

FOREIGN PATENT DOCUMENTS

| | | | |
|---|---|---|---|
| EP | 2103818 | B1 | 9/2013 |
| JE | 102008059536 | A1 | 6/2010 |
| WO | 2004083651 | A1 | 9/2004 |

* cited by examiner

BODY PROVIDED WITH A SUPERFICIAL AREA ADAPTED TO REDUCE DRAG

CROSS REFERENCE TO RELATED APPLICATIONS

This application is a 371 of PCT application number PCT/NL2017/050545 filed on Aug. 18, 2017, which claims priority from NL application number 2017402 filed on Sep. 1, 2016. All applications are hereby incorporated by reference in their entireties.

The invention relates to a body provided with a superficial area adapted to reduce drag when the body is moving relative to a gaseous or watery medium, comprising depressions in said superficial area.

The article by Choi K S, Clayton B R (2001) entitled The mechanism of turbulent drag reduction with wall oscillation. Int J Heat Fluid Fl 22(1):1-9 discloses that a lateral excitation of the turbulent boundary layer seems to decrease drag.

The article *Mechanics of drag reduction by shallow dimples in channel flow*, by C. M. J. Tay, B. C. Khoo, and Y. T. Chew; Physics of Fluids (1994-present) 27, 035109 (2015); doi: 10.1063/1.4915069 discloses arrays of shallow dimples with depth to diameter ratios of 1.5% and 5% that are provided in a turbulent channel flow at diameter-based Reynolds numbers between 5000 and 35 000. Pressure measurements show that a drag reduction of up to 3% is possible. The authors speculate that the mechanism of skin friction drag reduction with dimples is the same as that observed for flat surfaces using active methods such as spanwise wall motions or transverse wall jets. According to the authors the three dimensional dimples introduce spanwise flow components near the wall which results in streamwise vorticity.

There are further many other known variations in the construction of the superficial area of bodies to reduce their drag when moving in a gaseous or watery medium.

U.S. Pat. No. 8,323,775 discloses a superficial layer for reducing air resistance of a forward moving object, which layer comprises a pattern of surfaces rising in a first direction and channels running between the surfaces in a second direction at an angle to the first direction.

U.S. Pat. No. 5,114,099 shows waves that are provided in the superficial area of the body that are perpendicular to the flow of the medium along the body.

U.S. Pat. No. 8,573,541 shows a wavy airfoil, wherein the waves have peaks and valleys transverse to a virtual midplane of the airfoil.

US2015/0251711 shows spanwise waves in the surface of a motor hood of an automobile, which waves are perpendicular to a flow of a medium along the surface of the hood.

U.S. Pat. No. 6,006,823 relates to a streamlined surface providing control of a process in boundary and near wall layers of continues medium flows. The surface is provided with dimples.

Also US2009/0090423 relates to the application of dimples in a surface area of a body aimed at inducing tornado like jets connected with the boundary layer of the flow along the body.

WO2004/083651 discloses a surface along which a medium flows, wherein the surface is provided with dimples and wherein the edges of the dimples are rounded thereby forming a central dimples area and at least one curvature area for each dimple which connects the dimple to the surrounding surface.

EP 2 103 818 shows yet another surface provided with dimples for reducing drag resistance, wherein the dimples are formed by second-order convex and concave surfaces conjugate on common tangents.

US2007/0110585 shows a body provided with a superficial area adapted to reduce drag when the body is moving relative to a gaseous or watery medium, comprising depressions in said superficial area, wherein the depressions have a greater length than width and are provided in the superficial area so as to collectively shape a curvature provided in a length direction of said depressions in the superficial area, and/or said depressions themselves are provided with a curvature in their length direction. It results in the generation of a micro-turbulent flow in or near the depressions.

It is an object of the invention to reduce the drag that the body experiences when it moves relative to a gaseous or watery medium.

The object of the invention is promoted by a body and a method to reduce the drag of said body, having the features of one or more of the appended claims.

According to the invention said body which is provided with a superficial area adapted to reduce drag when the body is moving relative to a gaseous or watery medium, and which comprises depressions in said superficial area, has the feature that the depressions are deprived of sharp edges in a transitional area wherein the depressions meet the superficial area, and that the depressions have a maximum depth relative to be superficial area of 5% of the smallest of the depressions' width or length so as to cause that in use a turbulent boundary layer of the gaseous or watery medium adjacent to the superficial area is exposed to lateral excitation with reference to a movement direction of the body relative to the gaseous or watery medium or with reference to a flow direction of said turbulent boundary layer along said superficial area of the body.

The invention is based on the insight that said curvature with the mentioned features arranges that in use vortices are prevented and that a turbulent boundary layer of the gaseous or watery medium adjacent to the superficial area is exposed to lateral excitation with reference to a movement direction of the body relative to the gaseous or watery medium or with reference to a flow direction of said turbulent boundary layer along said superficial area of the body. The result of this lateral excitation is in a specific embodiment up to 4% reduction of drag of the body moving relative to the gaseous or watery medium.

In one preferred embodiment the transitional area exhibits a radius r and the depressions exhibit a radius R, wherein the radius r and the radius R are selected at values to satisfy the relation $r>0,1*R$.

There are numerous ways in which the curvature can be provided in the superficial area of the body, preferably however there are multiple curvatures that are provided staggered, parallel or antiparallel with respect to each other in the superficial area.

The inventors have found that suitably the curvature or curvatures are wavy and comprising a shape of a sinus or cosines, or suitable combinations thereof.

The invention will hereinafter be further elucidated with reference to the drawing of some exemplary embodiments of a superficial area of a body embodied according to the invention, and not limiting as to the appended claims.

Figure 7:
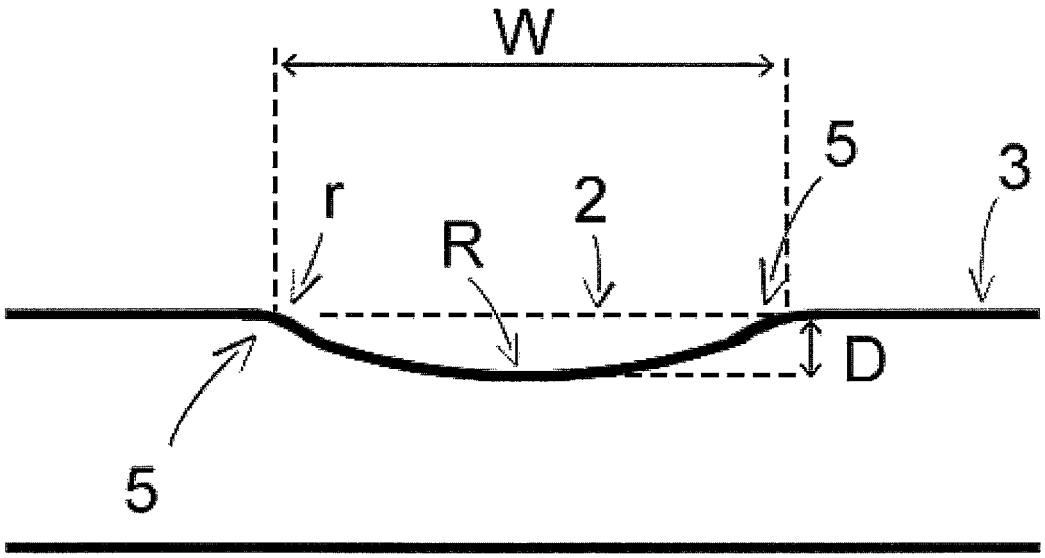

In the drawing:

FIGS. 1-6 show examples of curvatures in the surface area of a body according to the invention; and FIG. 7 shows a typical example of a cross-sectional view through one of the bodies shown in FIGS. 1-6.

Whenever in the figures the same reference numerals are applied, these numerals refer to the same parts.

The provided examples in FIGS. 1-6 are based on the inventive thought to reduce drag of a moving body 1 relative to a gaseous or watery medium by providing the body 1 with depressions 2 in a superficial area 3 of the body 1, wherein the depressions 2 are adapted to provide that a turbulent boundary layer of the gaseous or watery medium adjacent to the superficial area 3 of the body 1 is exposed to lateral excitation with reference to a movement direction of the body 1 relative to the gaseous or watery medium or—which is effectively the same—with reference to a flow direction (as indicated with the arrow 4) of said turbulent boundary layer along said superficial area 3 of the body 1.

Figure 3:
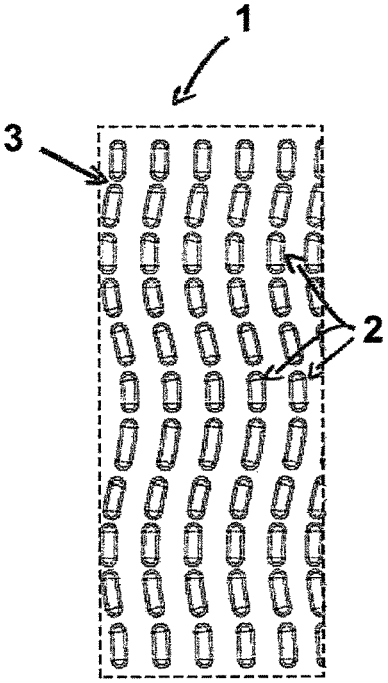
Figure 4:
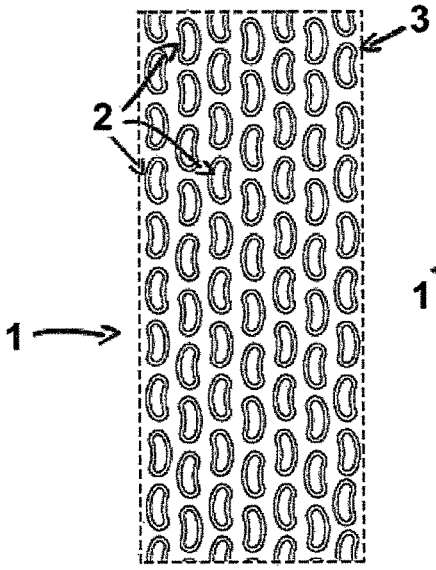

All embodiments in FIGS. 1-6 have in common that the depressions 2 have a greater length (which measures in the direction of arrow 4) than width (which measures in a direction transverse to the direction of arrow 4), and exhibit the feature that the depressions 2 in the superficial area 3 either collectively shape a curvature in the length direction of said depressions 2 in the superficial area 3 (as in the embodiments of FIGS. 1, 2, 3, 5 and 6), and/or that said depressions 2 themselves have a curvature in their length direction (as in the embodiment of FIG. 4).

Further to increase effectivity of the drag reduction of the body 1 it is desirable that the superficial area 3 is provided with multiple curvatures in a staggered (FIGS. 4 and 5), parallel (FIGS. 1, 2, 3) or antiparallel (FIG. 6) orientation with respect to each other.

Figure 5:
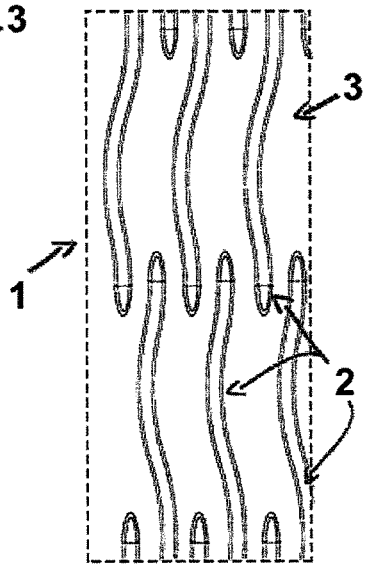
Figure 6:
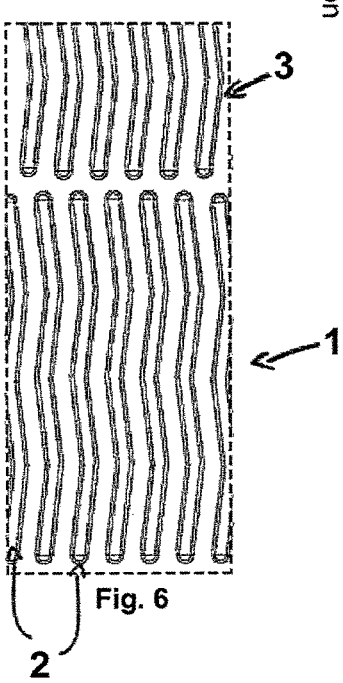

In some embodiments it is beneficial that the curvature or curvatures are provided with the shape of a sinus or cosines, as is shown in the embodiments of FIGS. 1, 3 and 5.

With reference to FIG. 7 it is pointed out that all depressions 2 in the bodies shown in FIGS. 1-6 have in common that the depressions 2 are deprived of sharp edges in a transitional area 5 wherein the depressions 2 meet the superficial area 3, and that the depressions 2 have a maximum depth D relative to be superficial area 3 of 5% of the smallest of the depressions' width W or length. For clarity the drawing of FIG. 7 is out of proportion so the actual measures in FIG. 7 need not exactly correspond to this feature. It is particularly the just mentioned feature elucidated with reference to FIG. 7 that causes that in use a turbulent boundary layer of the gaseous or watery medium adjacent to the superficial area 3 is exposed to lateral excitation with reference to a movement direction of the body 1 relative to the gaseous or watery medium or with reference to a flow direction 4 of said turbulent boundary layer along said superficial area of the body 1.

Particularly with reference to the absence of sharp edges, it is found that best results are achieved when in the transitional area 5 a radius r exists and that the depressions 2 have a radius R, and that the radius r and the radius R are selected at values to satisfy the relation r>0,1*R.

Although the invention has been discussed in the foregoing with reference to some exemplary embodiments of the features of the invention, the invention is not restricted to these particular embodiments which can be further varied in many ways without departing from the invention. The discussed exemplary embodiments shall therefore not be used to construe the appended claims strictly in accordance therewith. On the contrary the embodiments are merely intended to explain the wording of the appended claims without intent to limit the claims to these exemplary embodiments. The scope of protection of the invention shall therefore be construed in accordance with the appended claims only, wherein a possible ambiguity in the wording of the claims shall be resolved using these exemplary embodiments.

The invention claimed is:

1. A body provided with a superficial area adapted to reduce drag when the body is moving relative to a gaseous or watery medium, comprising depressions in said superficial area, wherein the depressions have a greater length than width and are provided in the superficial area so as to collectively shape a curvature provided in a length direction of said depressions in the superficial area, and/or said depressions themselves are provided with a curvature in their length direction, characterized in that the depressions are deprived of sharp edges in a transitional area wherein the depressions meet the superficial area, and that the depressions have a maximum depth (D) relative to the superficial area of 5% of the depressions' width so as to cause that in use a turbulent boundary layer of the gaseous or watery medium adjacent to the superficial area is exposed to lateral excitation with reference to a movement direction of the body relative to the gaseous or watery medium or with reference to a flow direction of said turbulent boundary layer along said superficial area of the body.

2. The body according to claim 1, characterized in that in the transitional area a radius r exists and that the depressions have a radius R, and that the radius r and the radius R are selected at values to satisfy the relation r>0,1*R.

3. The body according to claim 1, characterized in that there are multiple curvatures that are provided staggered, parallel or antiparallel with respect to each other in the superficial area.

4. The body according to claim 1, characterized in that the curvature or curvatures are wavy and comprising a shape of a sinus or cosines or suitable combinations thereof.

5. A method to reduce drag of a body moving relative to a gaseous or watery medium by providing the body with depressions in a superficial area of the body, comprising the step of providing the depressions with a greater length than width in the superficial area of the body so as to collectively shape a curvature in a length direction of said depressions in the superficial area, and/or providing that said depressions themselves have a curvature in their length direction, characterized by providing that the depressions are deprived of sharp edges in a transitional area wherein the depressions meet the superficial area, and providing that the depressions have a maximum depth (D) relative to the superficial area of 5% of the smallest of the depressions' width so as to cause that a turbulent boundary layer of the gaseous or watery medium adjacent to the superficial area of the body is exposed to lateral excitation with reference to a movement direction of the body relative to the gaseous or watery medium or with reference to a flow direction of said turbulent boundary layer along said superficial area of the body.

6. The method according to claim 5, characterized by providing that in the transitional area a radius r exists and that the depressions have a radius R, and that the radius r and the radius R are selected at values to satisfy the relation r>0,1*R.

7. The method according to claim 5, characterized by providing the superficial area with multiple curvatures in a staggered, parallel or antiparallel orientation with respect to each other.

8. The method according to claim 5, characterized by providing the curvature or curvatures with the shape of a sinus or cosines, or suitable combinations thereof.

9. Body according to claim 1, wherein, during use, vortices are prevented to form in the depressions.

10. Method according to claim 5, wherein, during use, vortices are prevented to form in the depressions.

* * * * *